US005561973A

United States Patent [19]

St. Germain

[11] Patent Number: 5,561,973

[45] Date of Patent: Oct. 8, 1996

[54] FLEXIBLE SLING CONSTRUCTION REINFORCED BY EYE PARTS EXTENDED IN OPPOSITE LONGITUDINAL DIRECTION THROUGHOUT MULTIPLE BODY PARTS IN REVERSE ROTATIONAL INTERWINE

[76] Inventor: Dennis St. Germain, 358 High Ridge Rd., Chadds Ford, Pa. 19317

[21] Appl. No.: 769,950

[22] Filed: Sep. 30, 1991

[51] Int. Cl.[6] ..... B66C 1/12

[52] U.S. Cl. ..... 57/22; 57/25; 57/202; 294/74

[58] Field of Search ..... 57/21–23, 25–27, 57/200, 202; 294/74

[56] References Cited

U.S. PATENT DOCUMENTS

| | | | |
|---|---|---|---|
| 1,839,698 | 1/1932 | Novotny | 57/22 X |
| 2,199,958 | 5/1940 | Mazzella | 294/74 |
| 2,299,568 | 10/1942 | Dickey | 294/74 |
| 2,325,261 | 7/1943 | Mazzella | 57/202 X |
| 3,079,192 | 2/1963 | Otley | 57/202 X |
| 4,043,581 | 8/1977 | St. Germain | 57/202 X |
| 4,240,659 | 12/1980 | St. Germain | 284/74 |

*Primary Examiner*—Michael R. Mansen
*Attorney, Agent, or Firm*—Anthony J. McNulty

[57] ABSTRACT

A flexible sling construction, without external compression sleeves or termination splices, made from three strands of material twisted into a single length of cable and formed into a nine strand body section having eye closure loops comprising six strands at each end thereof which eye closures are formed by looping each end of the cable back upon itself and inserting the cable end through the strands of cable at points removed from each end, and which body is formed by helically winding the first end of cable which extends from a first eye closure back around the body in the direction of the second eye closure and then wrapping it around the second eye closure to form a flemish eye, then leading the first end of cable and winding it in a helical wind back around the body and returning it in a direction toward the first eye closure, and wrapping it to form another flemish eye, and terminating the construction by splitting apart the end of the three strands of the first end of cable length and splicing the separated strands into engagement with the body of the sling.

1 Claim, 3 Drawing Sheets

FLEXIBLE SLING CONSTRUCTION REINFORCED BY EYE PARTS EXTENDED IN OPPOSITE LONGITUDINAL DIRECTION THROUGHOUT MULTIPLE BODY PARTS IN REVERSE ROTATIONAL INTERWINE

BACKGROUND OF THE INVENTION

1. History of the Technology

Heretofore, artisans in the field of sling technology generally required very large slings formed of a single cable strand of large diameter to provide the capacity to lift heavy loads. Such large slings were heavy and difficult to work with because they were not flexible. Slings of such large proportions also required larger sleeves or collars to maintain them in an assembled configuration. It was generally necessary to employ very large and expensive equipment to form an industrial grade sling when working with such large diameter heavy strand cable.

2. Discussion of the Prior Art

The sling assembly of this invention employs a splice for joining the members of the eye structure to the body structure which is different from the teachings of the prior art which shows the use of the same number of strand components from the eye structure to splice into the body part components. In the instant invention, the tensile strength of the sling assembly is greater than expected because there is less interruption of the load bearing function because less cable strand components form its splice structure. This is described in detail in the summary of the invention.

The prior art concerning sling construction teaches the formation of eye structures first before the body structure, but in this invention, the eyes are formed last. The sling industry has traditionally used only one body strand member out of which the eyes are formed and the body structure is formed by means of a series of double backs and overlaps with a central core member in the body structure. In the present invention, the body structure is formed of three separate body strand members.

The prior art sling structures require larger assemblies to develop the capacity for load lifts which can be achieved by the smaller, lighter, more flexible slings of this invention. Since the prior art required the use of very large slings to lift very heavy loads, it also demanded the use of large expensive sling construction equipment, whereas the slings of this invention can be constructed by hand with little or even no equipment.

SUMMARY OF THE INVENTION

A sling assembly formed by intertwining or braiding identical component sling constructions each having a body which includes three cable parts which may be formed or woven from a single cable member which braiding provides a multiple body part sling construction which has no specific core member and which comprises an eye at each end which are formed by opposite direction rotational means and which are terminated by means of a splice which obviates sleeve or collar means.

In this sling assembly, the body is comprised of three members in which the outside member is wrapped around the other two members to form a braid by fastening,the distal ends of each member to a rotating means which causes each of said body part members to rotate and wrap around the outer parts of the other body members to form the final composite body structure. After the multiple body part braid is completed, the distal ends of the sling assembly are formed into an eye at each end thereof.

The eye portions of the sling assembly of this invention are formed into a three dimensional plate instead of the flat weave configuration which is the result of laying the distal ends of the composite body part members in an overwrap. In forming a flemish eye for the sling assembly of this invention which is comprised of three body part members, the distal ends of the body part components are inserted back through the composite body structure at a predetermined mark distance from its center point so they form an eye loop and penetrate back into the body structure between the outermost body member and the two inside body members. The aforesaid method of inserting the distal ends of the cable that formed the eye loop is repeated while the assembly is rotated counterclockwise and continues until the multi-part braid reaches the other end of the assembly at the equivalent predetermined mark distance from the opposite distal end of said assembly. The cable ends are continuously braided as aforesaid and form a helical wrap around the eye and, when starting from three cable members, it results in a nine part load bearing or load lifting body structure between the aforesaid eyes at the distal ends of the sling assembly. The opposite overlap of end cable between the eyes can be wound on their return in a braid around the opposite loop eye. The final assembly comprises a nine member body part and a twelve member end loop eye.

The aforesaid winding of the distal ends of cable of the sling assembly back into the body structure is rotated in opposite direction for winding in the cable which forms the eyes at each distal end. If the first flemish eye end was formed using a counterclockwise rotation, then the opposite flemish eye end is formed using a clockwise rotation. This method of winding the sling assembly in opposite directions during its flemish eye formation provides a type of internal torque balance which gives the final sling assembly a built-in resistance to rotation.

The aforesaid second loop eye of the sling assembly is terminated by means of a splice where the three member cable components coming out of the eye are spliced into each sub-body component which in the case of a three cable strand subcomponent means that the three free ends of cable which formed the eye are split apart from each other and each separate part is wrapped around one of the three segments of the main body part of the assembly structure to form a four part splice structure. This splice member of the sling assembly is an integrated flexible connection which only uses the three separated cable strands from the flemish eye. This splice does not have all the body strands spliced into the body of the sling which is different from the splice in a standard sling. There are only three ends spliced into nine body parts which means that the splice structure is comprised of only twenty-five percent (25%) of the eye.

The aforesaid sling assembly may be terminated below said splice of said second eye into said body to secure said splice by means of a burning method for burning off any free cable which may extend beyond said splice by about six inches. This method of termination obviates the need for sleeve means or collar means which are commonly used in the industry. At the aforesaid splice juncture in the sling assembly of this invention, said eye cable ends which are split apart are laid into the interstices between the component strands of the load lifting body structure which supplements and increases the load bearing capacity of the splice structure of said sling assembly.

An advantage of the use of a three member platted body structure having its eyes at opposite ends rotated in opposite direction from each other,the one clockwise and the other counterclockwise, is that it is self-locking and more balanced and resists stress forces. The body structure which is a three member intertwined structure, is further balanced or stabilized by the counter rotational interweaving of the cable strands which formed the eyes at its opposite ends. Since the eye cable strands are wound in opposing helical fashion similar to the DNA molecule through the first formed body cable strands which were intertwined without a center core strand, the resultant structure is more stable because it has fewer stress points than if the eye cable strands were merely braided or platted around the first-formed body structure.

An additional feature of the sling structure of this invention is that the cable ends which emerge beyond aforesaid splice structure can be used to detect whether the splice is slipping out of place which could result in a sling failure. If said strand member which extends beyond the splice structure is visibly shortened in such extension length, then this will serve as a safety alert to the rigger to check for sling overload conditions, or sling defect conditions. The aforesaid extended strand member will move toward the direction of an overload point, but it ought not move from its initial rest position when the sling is not used beyond its rated capacity.

Still further, another advantage inherent in the sling structure of this invention is its enhanced flexibility because the hand spliced structure permits the cable strands to bend throughout the length of the sling. These slings are easier to store and ship because of their being more flexible than prior art slings. Another significant advantage is that these slings do not require a sling or collar for the connection of the splice.

A significant advantage which is derived from the option of not being required to splice all of the cable strands from the eye formation into the first-formed body structure; since only three cable strand ends from the eye structure are spliced into the nine cable strands of said body structure, the sling structure assembly of this invention can be constructed by hand so that the manufacturing process requires less tools and machinery.

A further advantage is obtained when working with cable which is comprised of multiple strands which are coated with a material, such as a plastic wrap of polypropylene; there is no need to open the coating material so the splice can be formed by interlocking said end cable strands extended from the eye enclosures around and through said coated or encapsulated strands which form the body part of the sling.

A significant advantage in using the slings of this invention is that they tend not to rotate or spin when under load; it is believed that this balance or stability is a result of the opposing rotational intertwining of the component cable strands during manufacture.

DESCRIPTION OF THE DRAWINGS

FIG. 4 and FIG. 5 show the completion of the first eye enclosure which is identified by Numeral 6' in FIG. 4 and FIG. 5; after completing the second eye enclosure, the long free end of base cable 1 is wound in helical configuration around said six part intermediate body to form a nine part body and it continues to wind through said first eye enclosure 6' to form a second flemish eye configuration identified by Numeral 4' in FIG. 5; then the three component strands of base cable 1 are spliced back in with said nine part body structure 5 to form a second twelve part spliced section 8' nearer said first enclosure eye 6' which terminates at the body point identified as Numeral 7' in FIG. 5.

Figure 1:
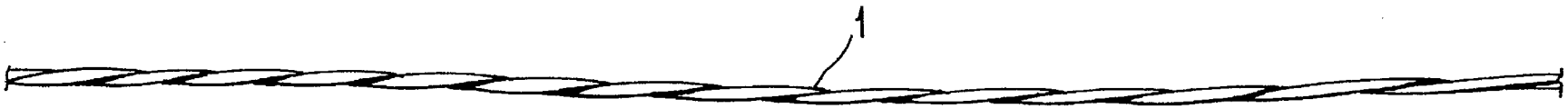
FIG. 1 is a plane view of three strands of steel wire or fiber material which are twisted to form a single length of cable structure having two free ends which cable is identified by the Numeral 1. The fiber material can be selected from natural or synthetic fiber, such as kevlar or polyester.
Figure 2:
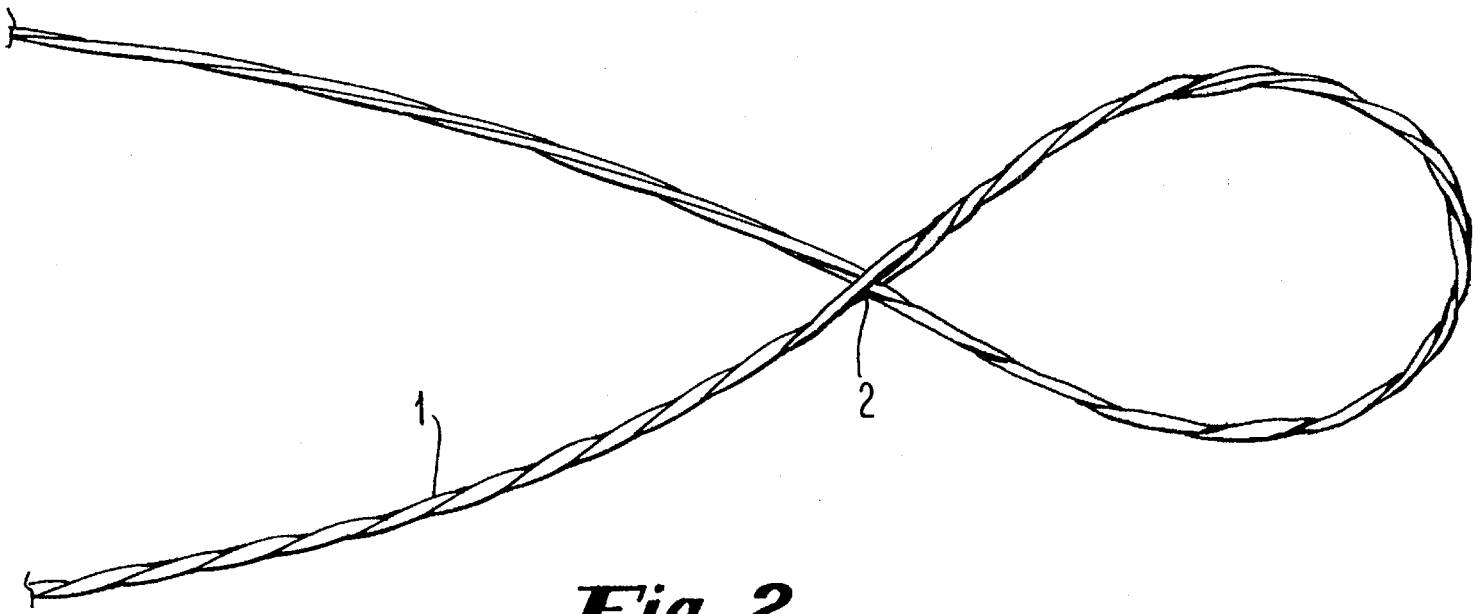
FIG. 2 is a plane view of the formation of a first end closure loop or eye enclosure showing the manner in which the first end of the three part base cable 1 is looped back upon itself and inserted back through the strands of base cable structure at the first eye enclosure interlock site identified by Numeral 2. Said first end of the base cable extending through aforesaid eye interlock begins its return in a helical rotation winding around the body of said base cable travelling towards the second end of the base cable while forming a six part cable body construction which is identified by Numeral 3 in FIG. 3.
Figure 3:
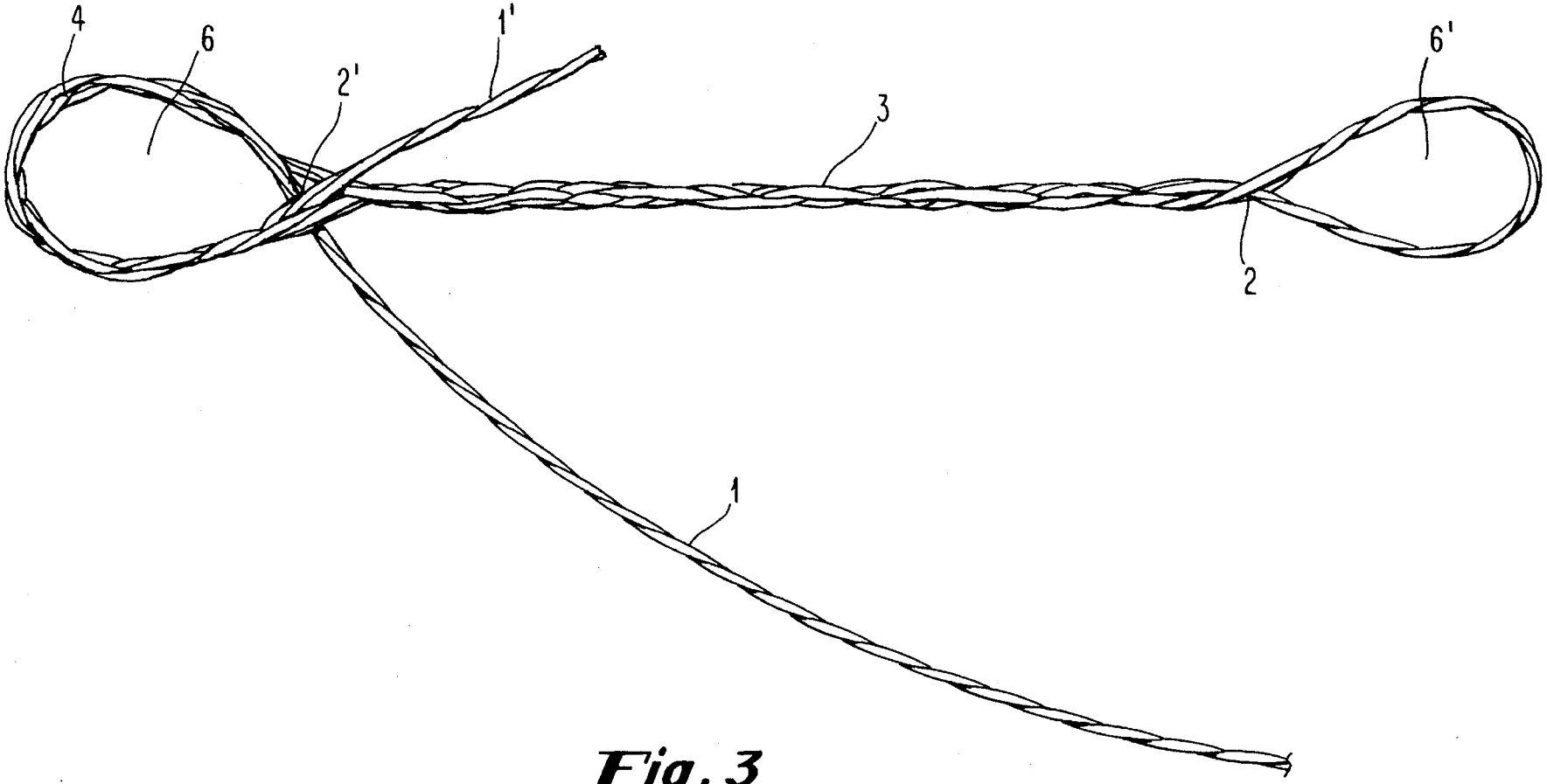
FIG. 3 is a perspective view of the completed intermediate construction which comprises a six part body 3, and a second eye enclosure loop formed by inserting the second end of the three part base cable structure identified by 1' back through the base cable at the second eye enclosure interlock site identified by the Numeral 2', and which shows said first end of the base cable being wrapped around the second eye enclosure in the opposite direction to form a flemish eye configuration identified by Numeral 4. The long free first end of the base cable begins its return in a helical rotation winding around the six part intermediate cable body travelling towards the first eye enclosure while forming a nine part cable body construction which is identified by Numeral 5 in FIG. 4. The second eye enclosure which is identified by Numeral 6 is completely formed with twelve parts of cable in the eye when attached to a load point. The short free second end of the base cable 1' which was inserted back at interlock 2' is spliced back into the body of the sling construction as shown in FIG. 4.
Figure 4:
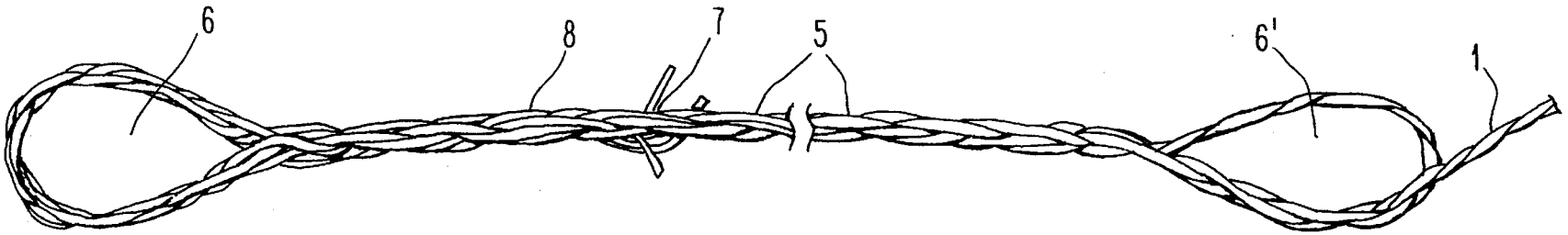
FIG. 4 is a perspective view which shows the second free end of the base cable which extended from the second eye enclosure spliced back into the body of the sling construction and terminated at a point in said body identified by the Numeral 7 which is nearer to the second eye enclosure. The completed nine part body structure identified by Numeral 5 is shown in FIG. 4 and FIG. 5. The section of the sling construction between the second eye enclosure 6 and the splice termination 7 consists of a reinforced twelve part body structure identified by the Numeral 8 in FIG. 4 and FIG. 5. The three component strands of the second end of the starting three cable strands base cable structure which were shown as Numeral 1' in FIG. 3 are spliced in interlocking arrangement back with the nine part body structure 5 to form a twelve part spliced sling section 8 near said second enclosure eye 6.
Figure 5:
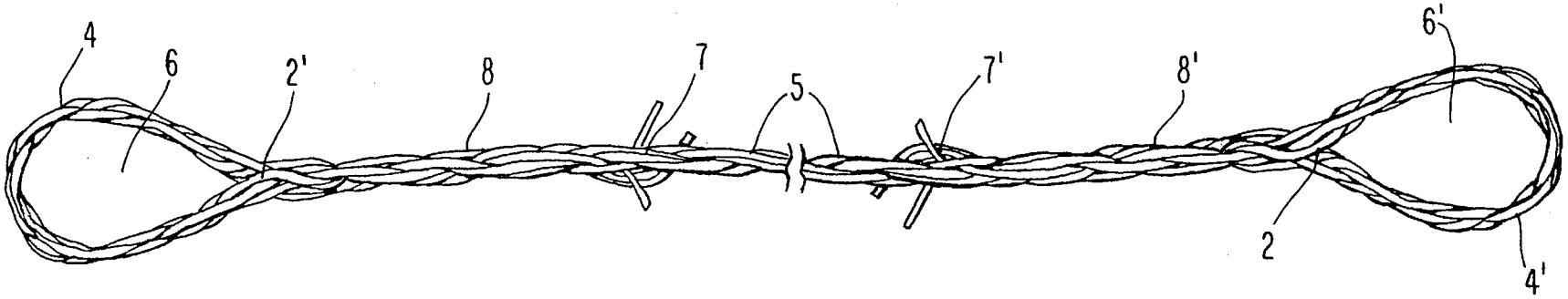
FIG. 5 is a perspective view of the completed sling structure of this invention which is flexible and balanced against internal rotation under a load stress. This drawing shows a sling construction comprised of eye enclosures each comprised of twelve strands at its distal ends, twelve part spliced body sections adjacent to each eye enclosure, and a nine part body section between the splices.

What is claimed is:

1. A method of constructing a flexible lifting sling which comprises twisting three strands of material into a single length of cable body having two ends, inserting a first end of said cable through the strands of cable at a point removed from its first end to form a first eye shaped closure loop at the first end of the cable body, leading said first end of cable and winding it in a helical wind and continuously advancing it in a helical wind in the direction of the second end of said cable to form a six part cable body, inserting the second end of cable through the strands of cable a point removed from its second end to form a second eye shaped closure loop, wrapping said first end of cable around said second eye closure loop to form a flemish eye, leading said first end of cable and winding it in a helical wind around said body and returning it in an opposite helical wind direction from its first helical wind toward said first eye closure loop to form a nine part cable body, wrapping said first end of cable around said first eye closure loop to form a flemish eye, separating said first mentioned three twisted strands at said first cable end to a point removed from its first end then inserting said three separated strands between the strands of said nine part body in spliced engagement therewith in a longitudinal direction leading to said second eye closure loop to form a twelve strand splice and separating said first mentioned three twisted strands at said second cable end to a point removed from its second end then inserting said three separated strands between the strands of said nine part body in spliced engagement therewith in a longitudinal direction leading to said first eye closure loop to form a twelve strand splice.

* * * * *